US006957606B1

(12) United States Patent
Walther

(10) Patent No.: US 6,957,606 B1
(45) Date of Patent: Oct. 25, 2005

(54) PRINTER FOR PRINTING CORRUGATED CARDBOARD

(75) Inventor: Thomas Walther, Freigericht (DE)

(73) Assignee: Man Roland Druckmaschinen AG, Offenbach (DE)

( * ) Notice: Subject to any disclaimer, the term of this patent is extended or adjusted under 35 U.S.C. 154(b) by 0 days.

(21) Appl. No.: 10/111,929

(22) PCT Filed: Oct. 31, 2000

(86) PCT No.: PCT/EP00/10752

§ 371 (c)(1),
(2), (4) Date: Aug. 5, 2002

(87) PCT Pub. No.: WO01/32436

PCT Pub. Date: May 10, 2001

(30) Foreign Application Priority Data

Nov. 2, 1999 (DE) ..... 199 52 802

(51) Int. Cl.[7] ..... B41F 3/00
(52) U.S. Cl. ..... 101/376; 101/216
(58) Field of Search ..... 101/217, 216, 101/212, 375, 376, 379, 368

(56) References Cited

U.S. PATENT DOCUMENTS

| | | | | |
|---|---|---|---|---|
| 3,652,376 | A * | 3/1972 | Bowden, III | 442/104 |
| 4,817,527 | A * | 4/1989 | Wouch et al. | 101/389.1 |
| 5,350,623 | A | 9/1994 | Derrick | |
| 6,182,568 | B1 * | 2/2001 | Ogita et al. | 101/376 |
| 6,374,734 | B1 * | 4/2002 | Gaffney et al. | 101/376 |
| RE38,468 | E * | 3/2004 | Lane et al. | 101/375 |

FOREIGN PATENT DOCUMENTS

| | | |
|---|---|---|
| DE | 23 37 962 A1 | 7/1973 |
| DE | 44 37 025 A1 | 4/1996 |
| JP | 11 042869 | 2/1999 |

* cited by examiner

*Primary Examiner*—Anthony Nguyen
(74) *Attorney, Agent, or Firm*—Leydig, Voit & Mayer, Ltd

(57) ABSTRACT

An offset printing machine having a printing blanket cylinder with an outer smooth ink receivable surface and a blanket support layer about the blanket cylinder beneath the printing blanket. The blanket support includes a dimensionally stable support layer and a reversibly compressible functional layer which accommodates uneven surfaces in the printable material so as to effect high-quality, uniform printing in offset printing of such irregular surface material such as corrugated cardboard.

5 Claims, 2 Drawing Sheets

PRINTER FOR PRINTING CORRUGATED CARDBOARD

FIELD OF THE INVENTION

The invention relates to printing machines, and more particularly to a device for printing on uneven printable materials.

BACKGROUND OF THE INVENTION

Printing devices are known which have spacer elements that can compensate for surface unevenness on printable material during the transfer of a print image. In conventional printing methods, a print image is applied to a printable material by rolling cylinders or drums which carry the print image and guide the printable material. The print image is produced on a printing plate, and, if necessary, it is passed along to the printable material by means of a transfer cylinder.

In direct printing processes, such as high-relief printing using a flexible printing process i.e., a printing plate equipped with elevated printing surfaces, the print image is applied directly to the printable material.

In offset printing, which is an indirect printing process, the print image is transferred from a printing plate to a transfer cylinder, which is called the blanket cylinder. From there, the print image is transferred to the printable material. Normally, a flexible layer is applied to the blanket cylinder. In standard offset printing, a so-called printing blanket or rubber cloth is used. This printing blanket is dimensionally stable in its expansion plane but deformable in the transverse direction. It also can be compressible to a certain extent in the direction of its thickness. In this regard, it is known to provide compressible layers within a printing blanket.

Rubber cloths or printing blankets used in offset printing are required in the offset printing process for the transfer of the print image, and in particular, to compensate for surface unevenness in the printable material. Since the printing plates for offset printing usually consist of thin sheet metal or foils, they cannot adapt sufficiently to the surface of the printable material.

For satisfactory printing quality, a printing blanket must be pressed against the surface of the printable material with a relatively high contact pressure by using the blanket cylinder against the counter-pressure cylinder. This cannot be avoided even by the use of so-called compressible printing blankets, since they merely have greater deformability than the standard printing blankets, but yet still require a relatively large contact pressure.

Thus, when printing on uneven printing materials, there are limits to the conventional offset printing process. First, a printing blanket can only be deformed to a limited extent, and sufficient pressing of the printing blanket against the printable material to maintain an acceptable print quality is still required. The printable material has an equally limited load resistance.

Thus, for example, when printing on corrugated cardboard, a particular problem arises by reason of the internal structure of the corrugated carton. Since a corrugated connecting layer is provided between two covering layers in order to reduce the weight, a corrugated cardboard carton is not a homogeneous material. The cover layers used on the upper and lower sides of this type of corrugated cardboard are connected by means of a corrugated intermediate layer and only at certain points. When the surface of corrugated cardboard is stressed, irregular conditions appear across the surface. In particular, each cover layer is flexible in the regions between the connecting points with the corrugated intermediate layer, and thus these regions yield when stressed. The stresses occurring on the board during a printing process can adversely affect the uniformity in printing.

Therefore, it is now known to apply a flexible and compressible substrate beneath the printing plate in the flexible printing method. In this regard, it is assumed that the printing plate is itself not compressible, that is, it is rigid and the substrate permits movement of the printing plate with respect to the printing plate cylinder. As substrate, for example, a foam material is used which is located on a substrate that can withstand tensile load. By means of the load-resistant substrate, the flexible substrate can be tensioned simultaneously with the printing plate on the printing plate cylinder. Length expansion is not expected in this case. In this manner, the printing plate is permitted to follow the surface unevenness on the printable material, at least to a limited extent. The necessary deformation of the printing plate, however, results in a deterioration in print quality. This also results from the usually very inhomogeneous distribution of printed and non-printed regions on a printing plate. In addition, the registration of printing plates for the various print colors is very difficult.

In offset printing this type of procedure is not known or used. Of course, stretching the so-called substrate sheet on the printing blanket cylinder underneath the printing plates or printing blankets is a known procedure. But they only help with the alignment, and the perimeter of the printing blanket cylinder stretched with the printing blanket, or the perimeter of the forming cylinder tensioned with the printing plate must be adjusted to the conditions required in a printing process.

Furthermore, another method is used which is not comparable to the method of using the substrate for a printing plate. This method uses compressible printing blankets. A compressible printing blanket permits deformations due to thickness reduction only under comparatively high pressure. The deformations in these printing blankets required for adaptation to the surface structure of the corrugated cardboard in a printing process would necessarily result in destruction of the corrugated cardboard before the printing blanket could sufficiently deform. Therefore, no method has been known for use in offset printing that enables a uniform print distribution in the processing of corrugated cardboard in a single printing process.

OBJECTS AND SUMMARY OF THE INVENTION

It is an object of the present invention to provide a printing machine for printing high-quality print images on corrugated cardboard.

Another object is to provide a printing machine as characterized above which uses an offset printing method for producing high-quality and uniform print images on the surface of corrugated cardboard without mechanically damaging the corrugated board.

In carrying out the invention, a flexible substrate is provided underneath the printing blanket which enables increased deformation of the printing blanket radially to the printing blanket cylinder during the printing process. The deformation is possible with less force, in comparison to the deformation of a compressible printing blanket. At the same time, the length stability of the printing blanket is retained so that a good print quality is assured. Thus, printing on an uneven surface, such as that of corrugated cardboard, for example, is possible using offset printing. Moreover, a number of additional process advantages arise due to the offset printing method. In particular, these advantages include the use of less expensive printing plates and simpler registration during multi-color printing.

Other objects and advantages of the invention will become apparent upon reading the following detailed description and upon reference to the drawings, in which:

Figure 1:
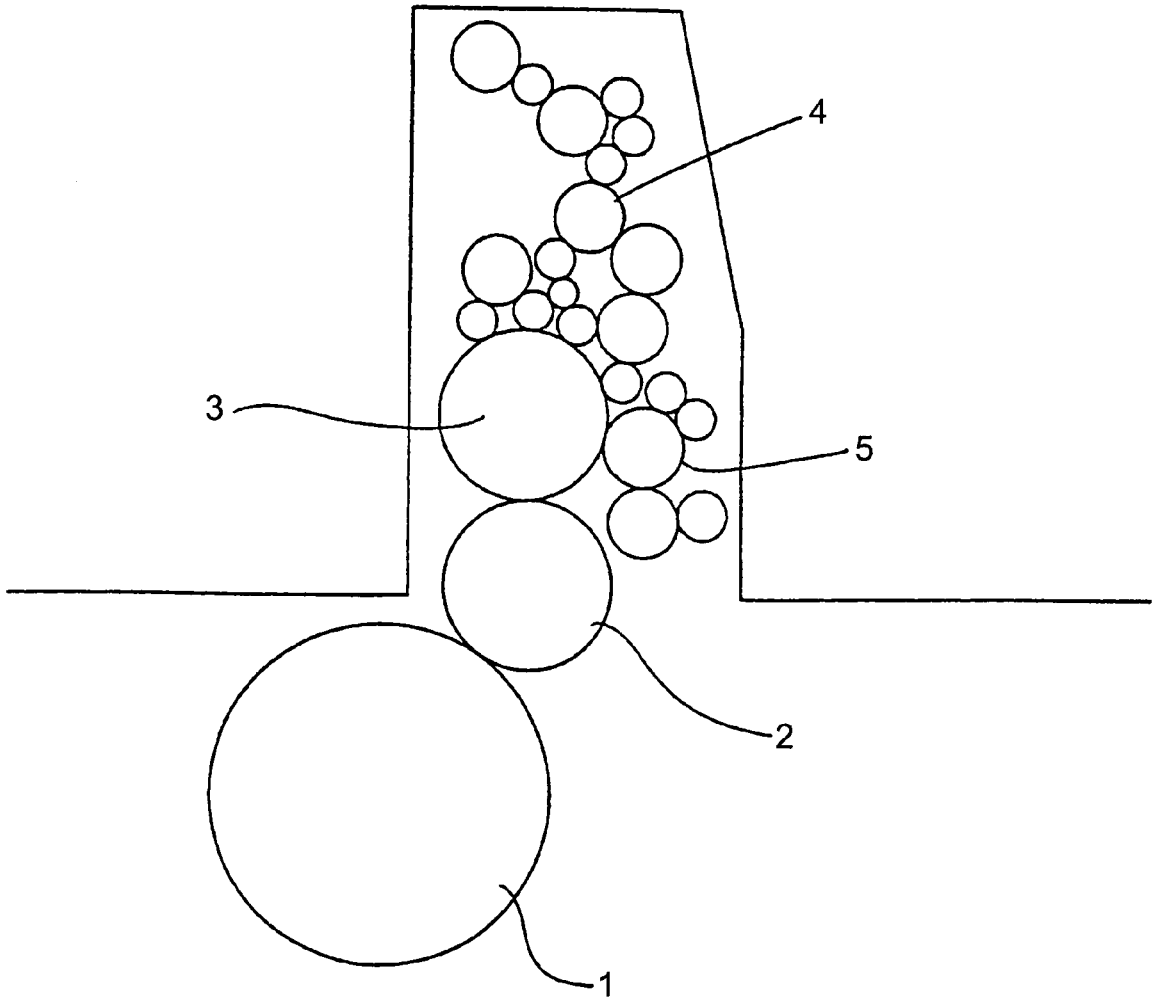
FIG. 1 is a partially diagrammatic side elevation of an illustrated offset printing machine in accordance with the invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring nor more particularly to FIG. 1 of the drawings, the is shown an illustrative offset printing machine embodying the invention which includes a counterpressure cylinder 1, a blanket cylinder 2, and a form cylinder 3. Associated with form cylinder 3 is an inking unit 4 and a moistening unit 5. As will be appreciated by one skilled in the art, the counterpressure cylinder 3 includes an appropriate gripper system for successively engaging the sheet material and guiding its movement past the blanket cylinder 2.

The blanket cylinder 2 has a printing blanket 7 tightly stretched and tensioned about its outer perimeter. The printing blanket 7 is dimensionally stable in length, or its expansion plane, but flexible in a transverse direction to its surface to a limited extent. The blanket 7 also is only slightly compressible.

The form cylinder 3 carries an appropriate printing plate, which in offset printing, consists of a thin metal plate. The printing plate is supplied with ink from the inking unit 4, and as is known in the art, printable surfaces are first differentiated from non-printable surfaces by water applied by the moistening unit 5. In this type of offset printing machine, the object is to transfer printing ink as uniform as possible over the surface of printable materials even though the printable materials have variable thickness and rigidity or other irregular surface characteristics.

Figure 2:
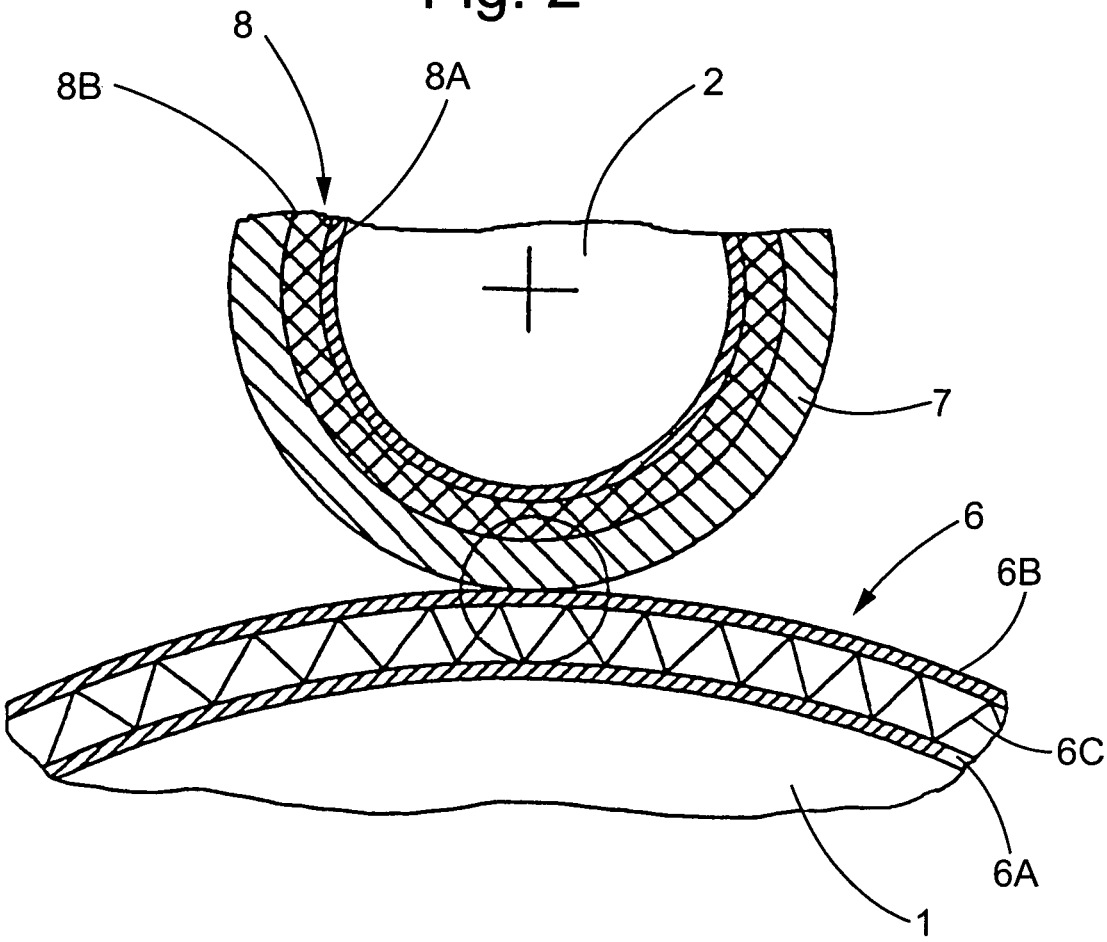
FIG. 2 is an enlarged fragmentary section illustrating the printing process of a print zone of the illustrated machine.

FIG. 2 illustrates a print zone between the blanket cylinder 2 and the counterpressure cylinder 1, although the diameters of the cylinders may not be representative. Printable material, in this case the corrugated cardboard 6, is shown about the lower counterpressure cylinder 1. The corrugated cardboard 6 consists of a lower cover layer 6A and an upper cover layer 6B. The two cover layers are joined together by a corrugated connecting layer 6C, and the lower cover layer 6B is glued to the lower edges of the connecting layer 6C, and the upper cover layer 6A is glued to the upper edges of the connecting layer 6C. Due to this connection, a very stable printable material is obtained, at least in regard to its bending strength. Printable materials in the form of corrugated cardboard 6 of such type are often used in the packing industry.

The printing blanket 7, as indicated above, is located about the outside of the blanket cylinder 2. While the printing blanket 7 is depicted as a homogeneous layer, it will be understood that such printing blanket, as is known in the art, may be designed as a rubber cloth composed of at least one non-stretchable base layer and one flexible cover layer. In addition, other intermediate layers that improve the functionality of the printing blanket 7 may be used.

In accordance with the invention, a replaceable substrate layer is provided on the blanket cylinder underneath the printing blanket which is elastically deformable in a radial direction to the blanket cylinder to accommodate surface contour variations in the material being printed. To this end, in the illustrated embodiment, a substrate 8 is provided directly on the printing cylinder beneath the printing blanket 7. The substrate 8 in this case is composed of a non-stretch foundation layer 8A, and located thereon, is a flexible cover layer 8B. The non-stretch foundation layer 8A can be a strong plastic film. The flexible cover layer 8B preferably is made of a layer of foam material with with the desired reversibly deformable characteristics. Due to the non-stretch foundation layer 8A, the printing blanket substrate 8 can be stretched together with the printing blanket 7 onto the blanket cylinder 2, with the foam being joined securely with the film. The surface of the blanket cylinder 2 consequently is identical to a standard blanket cylinder 2 with a printing blanket.

Figure 3:
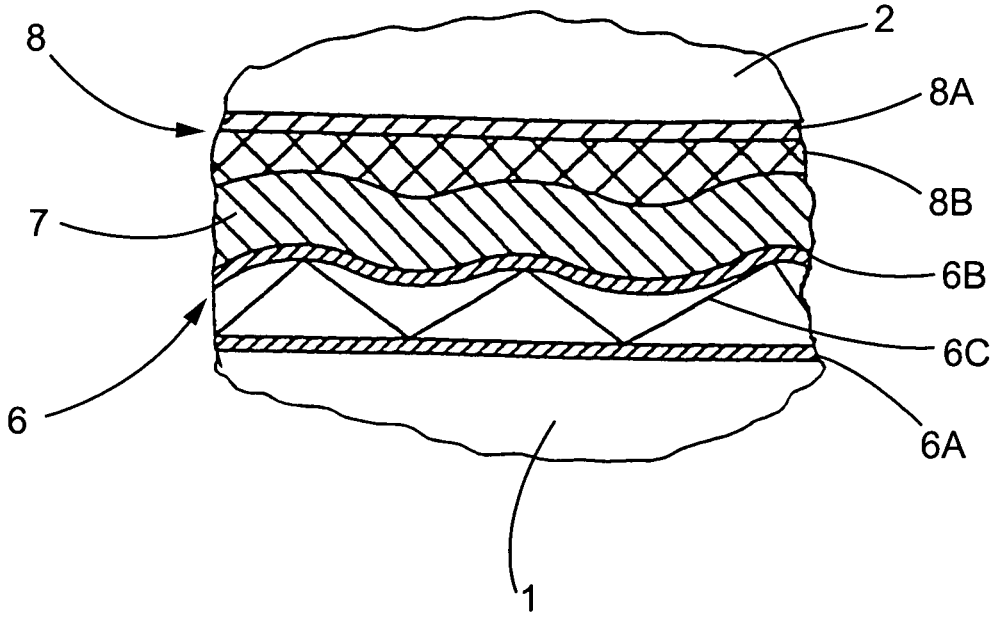
FIG. 3 is a more detailed representation of the illustrated print zone.

The printing zone depicted in FIG. 2. is illustrated in greater detail in FIG. 3 during a printing process. The printable material, i.e., in this case, the corrugated cardboard 6, is shown on the counterpressure cylinder 1 with its outer surface deformed by reason of the stresses incurred in passing through the printing zone. The printing blanket 7 also is deformed to conform to the deformed surfaces of the corrugated cardboard. The height differences with respect to the surface of the blanket cylinder 2, which is located at the top side, are compensated by the flexible cover layer 8B, i.e. the foam layer of the printing blanket substrate 8 which is in the form of a foam layer. The foam material of that layer is compressed at those places where the upper side of the corrugated cardboard 6 is solid, i.e., preferably in the region of the gluing with the connecting layer 6C. Thus, the printing blanket 7 can escape being deformed by bending. In the gaps between two solid webs of the corrugated cardboard 6, the printing blanket 7 can follow the deformable surface of the corrugated cardboard 6, and the flexible cover layer 8B can perform this compensating function due to its design as a foam layer. Hence, as depicted in FIG. 3, it will be seen that while the printing blanket 7 conforms to the irregular surface contour of the corrugated board 6, its radial thickness is substantially unchanged while the deformable support layer 8 absorbs the contour variations of the corrugated board and the printing blanket relative to the dimensionally stable inner support surface of the blanket cylinder 2.

By adjustment of the applied pressure, i.e., through the determination of the operating spacing of blanket cylinder 2 and counter-pressure cylinder 1, or by selection of different foam layers for the blanket support 8, the printing machine of the present invention can be used for different qualities of printable materials with uneven surfaces. In the case of relatively easily compressible printable materials, such as corrugated cardboard 6, as indicated in the present example, a softer foam is required than for relatively hard printable materials, such as solid cardboard.

The thickness of the blanket support 8 is important to the proper functioning of the device and to ensure the required print quality. Basically, for the stated application with corrugated board, the blanket support 8 may have a thickness of 0.5 mm to 3 mm. For applications with other known printable materials, blanket supports 8 with a thickness of 1 mm to 2 mm is preferred. With regard to the foam material, a reversibly compressible foam-which will last for several operating cycles is preferred. In this case, an open-cell foam is preferred.

From the foregoing, it can be seen that the printing machine of the invention is adapted for offset printing of high-quality and uniform print images on the surface of corrugated cardboard and other irregular surface materials without damaging the corrugated cardboard. Yet the blanket cylinder of the printing machine, which facilitates such high-quality printing, is relatively simple construction, and the deformable support layer of the blanket cylinder is readily removable and replaceable for ongoing high-quality printing.

What is claimed is:

1. A printing machine for printing on printable materials having an uneven or deformable surface comprising a form cylinder having a printing plate, a blanket cylinder adjacent the form cylinder for receiving printed images from the printing plate, a counterpressure cylinder adjacent the blanket cylinder for transferring printable material past the blanket cylinder, said blanket cylinder having a printing blanket stretched about a support surface of said blanket cylinder defining a smooth ink transferable outer surface of the blanket cylinder, said printing blanket being substantially dimensionally stable in length while being deformable in a radial direction without substantial compressive deformation such that the printing blanket maintains a substantially constant radial thickness during radial deformation, and said blanket cylinder having a removable and replaceable support layer which is directly positionable about the support surface of said the blanket cylinder in underlying relation to the printing blanket, said removable and replaceable support layer including a layer of open cell foam material which is elastically deformable in a radial direction to the blanket cylinder with a resulting change in radial thickness in response to pressure concentrations on the blanket by reason of uneven or deformable surfaces on the printable material, and said layer of foam material being fixed upon an outer surface of a dimensionally stable carrier layer having a radial thickness substantially less than the radial thickness of said layer of foam material.

2. The printing machine of claim 1 in which said printing blanket is a substantially incompressible rubber cloth stretched upon the blanket cylinder.

3. The printing machine of claim 2 in which said printing blanket is a slightly compressible rubber cloth stretched upon the blanket cylinder.

4. The printing machine of claim 1 in which said foam layer has a thickness of between 0.5 to 3 mm.

5. The printing machine of claim 1 in which said foam layer has a thickness of between 1.2 and 1.6 mm.

* * * * *